US008226313B2

(12) United States Patent
Brendel et al.

(10) Patent No.: US 8,226,313 B2
(45) Date of Patent: Jul. 24, 2012

(54) APPLICATOR DEVICE FOR LOOSE SUBSTANCES WITH INTEGRATED METERING DEVICE

(75) Inventors: Herbert Brendel, Nürnberg (DE); Thomas Heidenreiter, Kalchreuth (DE)

(73) Assignee: Schwan-STABILO Cosmetics GmbH & Co. KG, Heroldsberg (DE)

( * ) Notice: Subject to any disclaimer, the term of this patent is extended or adjusted under 35 U.S.C. 154(b) by 1192 days.

(21) Appl. No.: 11/957,528

(22) Filed: Dec. 17, 2007

(65) Prior Publication Data

US 2008/0149131 A1 Jun. 26, 2008

(30) Foreign Application Priority Data

Dec. 20, 2006 (DE) ..... 20 2006 019 204 U

(51) Int. Cl.
*A46B 11/00* (2006.01)

(52) U.S. Cl. ..... 401/118; 401/4; 132/298; 132/299

(58) Field of Classification Search ..... 401/4, 118, 401/126, 130, 200; 132/298, 299, 307
See application file for complete search history.

(56) References Cited

U.S. PATENT DOCUMENTS

| | | | | |
|---|---|---|---|---|
| 1,956,991 | A * | 5/1934 | Lowen | 132/299 |
| 1,999,227 | A * | 4/1935 | Bauer | 132/299 |
| 2,554,489 | A * | 5/1951 | Crane | 401/125 |
| 3,256,550 | A | 6/1966 | Laxalt | |
| 4,974,981 | A * | 12/1990 | Bennett | 401/123 |
| 7,192,211 | B2 | 3/2007 | Heidenreiter | |
| 2002/0172541 | A1 | 11/2002 | Gueret | |
| 2006/0104703 | A1 | 5/2006 | Heidenreiter | |

FOREIGN PATENT DOCUMENTS

| | | |
|---|---|---|
| DE | 202004020158 | 1/2006 |
| FR | 2 233 842 | 1/1975 |
| FR | 2233842 | 1/1975 |
| JP | 2004298515 | 10/2004 |
| JP | 2005007019 | 1/2005 |
| JP | 2005007020 | 1/2005 |

* cited by examiner

*Primary Examiner* — David Walczak

(74) *Attorney, Agent, or Firm* — Bachman & LaPointe, P.C.

(57) ABSTRACT

An applicator device for a loose substance, in particular a cosmetic substance such as a cosmetic powder, comprising at least one housing having a storage compartment for the substance and a handle portion on which is disposed an applicator which in the closed condition of the applicator device is arranged in the interior of the housing in the direction of the storage compartment, wherein a wall of the storage compartment, that is towards the applicator, includes passageways for the loose substance, and devices for producing at least one impact on at least one part of the storage compartment so that a part of the loose substance can be loaded on to the applicator through the permeable wall of the storage compartment by metering impacts.

6 Claims, 10 Drawing Sheets

APPLICATOR DEVICE FOR LOOSE SUBSTANCES WITH INTEGRATED METERING DEVICE

BACKGROUND OF THE INVENTION

The present invention concerns an applicator device for loose substances, in particular a cosmetic substance.

Devices and arrangements for applying cosmetic substances such as a powder are known from the state of the art. Thus for example pressed cosmetic powders can be taken from a small cup by means of an applicator. Here brushes or foam or also sponge rubber applicators are used as the applicators. Powder pencils are also known, in which a lead formed from pressed cosmetic powder is enclosed by a sheath of material which can be sharpened to a point. However self-supporting powder leads, in housings from which they can be advanced for application purposes, are also state of the art, as can be seen from example from DE 20 2004 020 158 U1.

A further application format involves containers from which a loose cosmetic substance such as a loose eyeshadow can be removed for example by being sprinkled therefrom.

There are also cosmetic containers which are summarised by the term dip systems. In those systems the applicator is usually loaded by being dipped into the loose or powder cosmetic which is contained in the container. In that respect, adhesion of the cosmetic substance to the applicator, that is to say loading of the applicator, is inter alia dependent on the filling level of the container. In that respect it was found in particular that the loading of the applicator surface occurs irregularly with a decreasing filling level in the container.

It is also known that an excess of cosmetic to be applied, on the applicator element, is undesirable as the cosmetic can drop off after the applicator element is withdrawn from the cosmetic container, and can possibly soil articles of clothing. Success with makeup is also endangered by inaccurately metered and in particular excessive cosmetic material. It is particularly disagreeable if excess material of that kind, for example when applying eyeshadow, gets into the conjunctival sac of the eye where irritation can occur. In order to avoid overdosing, for example DE 20 2004 017 614 U1 proposes a container from which a loose cosmetic substance can be taken in portion-wise manner by means of an applicator which is fixed to a stem, wherein excess cosmetic is knocked off by an impulse which can be produced by an insert portion disposed in the applicator stem or a handle portion. That arrangement admittedly substantially obviates the above-mentioned disadvantages of overdosing, but adjustment of an optimum dosage amount of substance to be applied still remains unresolved.

To sum up therefore it can be established that there is still potential for improvement in regard to metering of an amount of a cosmetic substance which is intended to be applied, particularly in the case of a loose powder.

Therefore an object of the present invention is to provide an applicator device for loose substances, in particular a cosmetic substance in powder form, which makes it possible to load the applicator with an amount of the loose substance, which is defined for application, in particular independently of the amount of substance present in the applicator device.

SUMMARY OF THE INVENTION

The object of the invention is attained by an applicator device having at least one housing with a storage means for a loose substance which in particular is in powder form and a handle portion on which there is disposed an applicator which in the closed condition of the applicator device is arranged in the interior of the housing in the direction of the storage means, wherein a wall of the storage means, that is towards the applicator, has passageways, the wall is permeable for the particles of the loose substance, and there are provided means for producing at least one impact on at least one part of the storage means so that a part of the loose substance can be loaded on to the applicator through the wall of the storage means by means of the impact loading which can be produced.

Preferably the loose substance which in particular is in powder form is a cosmetic substance, in particular a cosmetic powder.

It was found more specifically that metering which remains the same can be implemented by an impact which is pre-set at the device side and which is therefore substantially reproducible, in combination with the appropriately set permeability of a wall of the storage means for the loose substance. In that respect the direction of the impact appears to be immaterial. Furthermore, when using the applicator device according to the invention, the above-mentioned risk of soiling is considerably reduced and the makeup result, in the case of a cosmetic powder, is markedly improved by the application of a loading amount from the applicator, with the amount being pre-set at the device side.

In a first configuration by way of example of a first embodiment of the applicator device the means for producing the at least one impact are formed by an impact body in a hollow space provided for the impact body, wherein at least a part of the wall of the hollow space is in contact with the storage means or is fixedly connected thereto for the transmission of an impact produced.

In a second configuration by way of example of the first embodiment of the applicator device the means for producing the at least one impact are formed by an impact body in a hollow space provided for the impact body, wherein at least a part of the wall of the hollow space is formed by a part of the storage means for the transmission of an impact produced.

In a third configuration by way of example of the first embodiment of the applicator device the means for producing the at least one impact have an impact body in a hollow space provided for the impact body, wherein the hollow space is in contact with or is connected to the permeable wall of the storage means for the transmission of an impact produced.

Thus, in the first embodiment, by shaking the closed applicator device, that is to say when the handle portion is inserted with the applicator disposed inwardly, the at least one impact is produced by the freely movable impact body and is transmitted indirectly by way of the storage means containing the loose substance on to or directly on to the wall of the storage means, which wall is permeable to the loose substance and is arranged in adjacent relationship with the inserted applicator. The impact loading or shaking of the permeable wall means that the loose substance is knocked through the passageways or openings in the wall for metered loading of the applicator. In other words, the impacts which are produced in the applicator device according to the invention provide that the loose cosmetic material is caused to vibrate or shake in the region of the wall which is permeable for the loose substance, whereby the substance can be knocked through the wall in a similar manner to being knocked through a sieve.

The permeability of the wall—assessed for example with respect to a pass-through rate, that is to say the amount of loose substance which can be knocked through the wall per unit of time—can be set in particular by way of the dimensioning of the passageways in the wall and the means used for producing the impact.

By way of the properties of the impact body, the strength of the pulses which can be produced can be set at the production end substantially by means of the parameters of geometry and/or material density and/or the maximum travel distance, that is to say the free travel length available to the impact body, in the hollow space when the device is shaken.

It should also be noted that in principle the impact body can be of any shape which allows free mobility in the hollow space provided for the impact body. In other words the impact body is designed in such a way that it cannot become jammed in the hollow space which in principle can be of any desired geometrical shape, when the device is shaken. By way of example the impact body can be in the form either of a ball, a cylinder, a ring, a tube portion, a cube, a parallelepiped or a shear-off portion—an irregularly shaped piece from the production of balls—. Finally it is also possible to use a plurality of insert portions which are of the same shape or of different shapes.

The at least one impact body can comprise any material, a selection being made essentially from the point of view of specific weight or density. Suitable materials for the impact body are those which are sufficiently hard to be able to exert an impulse on the storage container or the wall of the storage space, the wall there being of a sieve-like structure, when the device is shaken. Metal, ceramic, glass, wood, leather or combinations thereof are basically suitable. The at least one impact body can also comprise a plastic material. In that respect plastic materials of homo-, co- and/or block polymers such as polyester, polyamide, polyolefin, styrene, polyurethane, polynitrile, polyacrylate, hard rubber, hard caoutchouc or a combination thereof are particularly suitable. Finally phenoplast, aminoplast, epoxy resin, urea formaldehyde condensate or the like are also suitable as the material.

A further aspect regarding the choice of the material can be that of producing a pleasant noise for acoustic feedback when the device is shaken. In other words, the choice of the material for the one or also plurality of impact bodies can be based on the impact body producing an attractive noise when it hits the wall of the storage space or the wall of the chamber, to produce the impulse. The insert portion then implements the function of an acoustic display for the male or female consumer for the metering operation which is initiated by the shaking procedure prior to any use.

Finally it should also be mentioned that it is admittedly advantageous but not compellingly necessary, in the design configuration with an impact body, for that impact body to be arranged in a condition of being separated from the substance in powder form in the storage space of the container, in a hollow space which is specifically provided for the impact body. That however improves the freedom of movement of the impact body and thus the effective transmission of force impulses to the storage container or directly to the permeable wall.

In a second embodiment of the applicator device the means for producing the at least one impact are formed by at least a part of the housing and a storage container which is arranged movably with respect thereto, as the storage means for the loose substance, wherein the storage container is movable as an impact body in the housing over a predetermined distance and a collision on the part of the storage container with abutments provided on the housing serves to produce the impact.

In a first configuration by way of example of the second embodiment the housing and the handle portion are connected together by means of a releasable connection in the closed condition of the applicator device.

In a second configuration by way of example of the second embodiment of the applicator device the storage container and the handle portion are connected together by means of a releasable connection in the closed condition of the applicator device.

It should be noted that the following features can be combined with all embodiments described hereinbefore or claim effectiveness in relation thereto.

The applicator for the loose substance can be in the form of a brush. A flat or areal element comprising a fabric, foam, leather, artificial leather, rubber sponge is also suitable for the application of a loose substance.

The applicator can also be produced by flocking a carrier material or by means of a multi-component injection procedure (when two plastic materials are involved, often referred to as the '2-component process').

The wall of the storage means or the storage container, which is permeable for the loose substance, can be of a mesh-like or sieve-like configuration. In that respect the mesh width of the mesh-like or sieve-like wall can be matched as an adjustable parameter in respect of permeability for the loose substance, to the particle size of the loose substance.

Alternatively the wall of the storage means, which is permeable for the loose substance, can be embodied in the form of an apertured (perforated) wall. In that case as the adjustable parameter of permeability, the geometrical dimensions of the individual holes can be matched to the particle size of the loose substance.

The openings provided in the permeable wall, for example meshes, holes, bores or the like, should substantially be larger than the largest particles of the loose substance so as to avoid a sieving-out effect, by which the composition of the substance which remains in the storage means is not altered.

It will be appreciated that the permeability of the wall does not have to be distributed equally over the entire area but, depending on the respectively intended effect, can be so adjusted that given locations of the applicator are loaded with a larger amount (metered dose) of the loose substance.

In this connection attention should also be directed to a development of the permeable wall with permeability which is not equally distributed, in respect of which the permeability distribution is so adjusted that, in regular use, a given pattern, for example the trademark of the manufacturer or optically attractive patterns such as a dot form or a heart shape, is produced on the applicator.

The wall of the storage means, which is permeable for the loose substance, can comprise metal, ceramic, cardboard, paper or plastic material or a combination thereof. Non-woven materials or fabrics can also be suitable, with appropriate structuring.

The reference to matching to the particle size means here in particular that the thickness of the permeable wall which determines the internal height of the passageways and the effective cross-section of the individual holes or passageways can be such that, by virtue of the interactions between the individual particles of the loose substance, the loose substance does not pass through the permeable wall without an external action thereon, but passes out of the storage means for loading the adjacent applicator surface only under the action of a metering impact.

In regard to the sieve-like wall the parameters which can be set at the production end in terms of the permeability of the permeable wall will be discussed in further detail hereinafter. Thus the diameter of the individual openings, that is to say the mesh width in the case of a material which is structured in a mesh-like fashion, but also the height of the sieve openings or meshes, can be adjusted. In the design using an apertured or perforated wall, the corresponding parameters for that purpose, besides the hole diameter and the hole height, that is to say the wall thickness, are the hole spacing and/or the number of holes per unit of surface area.

A secondary effect of that sieve action on the part of the wall which is permeable for the loose substance lies in the fine-grain nature, which is ensured thereby, of the substance which is loaded on to the applicator. Accordingly the applicator is loaded with an amount which is required for successful application. The loading amount or application amount can thus be substantially determined and controlled by the magnitude of the surface area and the permeability of the sieve-like wall, as well as by the pre-set maximum impulse.

To sum up it can be established that the success of using the cosmetic container according to the invention with applicator and integrated metering device for that purpose is basically improved. On the one hand, the impact body or the fact of the storage chamber hitting against abutments generates defined impulses or force impacts which cause controlled loading of the applicator element. In that case the sound which occurs when the metering impulses are produced provides an acoustic feedback for the metering operation when loading the applicator. In addition the function of the permeable wall of the storage means of the applicator device, similarly to a sieve, provides for loading the applicator with a predetermined amount, independently of the filling level of the cosmetic container, that is to say independently of whether the container is filled or already relatively greatly emptied.

It should also be mentioned that the component parts of the cosmetic container can preferably be manufactured in the form of plastic components from thermoplastic material using an injection molding or blow molding process. It is however also possible for the handle portion with applicator to be produced in a pressing process from a thermosetting material. It is equally possible to envisage using cardboard, glass, ceramic or metal.

In principle any closure mechanism which is easily releasable but secure against unintentional release is suitable as the closure mechanism for the cosmetic container with the handle portion carrying the applicator. Particularly in the operation of shaking the container which is intended on the part of the invention and which provides for the substance metering effect, the connection between the storage space and the handle portion should not be unintentionally released. Basically any possible way of connecting two parts together releasably is appropriate for a releasable connection between the handle portion and the housing or storage container. Thus it is possible for example to envisage a plug connection which prevents unintentional release by means of frictional engagement. Connecting mechanisms in the nature of a screw connection, a bayonet connection or a snap-action connection are preferred.

BRIEF DESCRIPTION OF THE DRAWINGS

Further advantages of the invention are described hereinafter with reference to the description of an embodiment by way of example of the present invention together with the drawings. The terms used in that respect 'left', 'right', 'down' and 'up' refer to the Figures of the drawings, with Figure identifications being normally readable. In addition it is to be noted that identical parts are denoted by the same references in the individual Figures. In the drawings.

DETAILED DESCRIPTION

Various embodiments of an applicator device with integrated metering function or details thereof are described in greater detail hereinafter with reference to FIGS. 1 through 10. Hereinafter, for the sake of greater clarity of description, and without limiting the invention thereto, it is assumed that the loose substance which is to be applied in metered fashion is a cosmetic powder.

Figure 1:
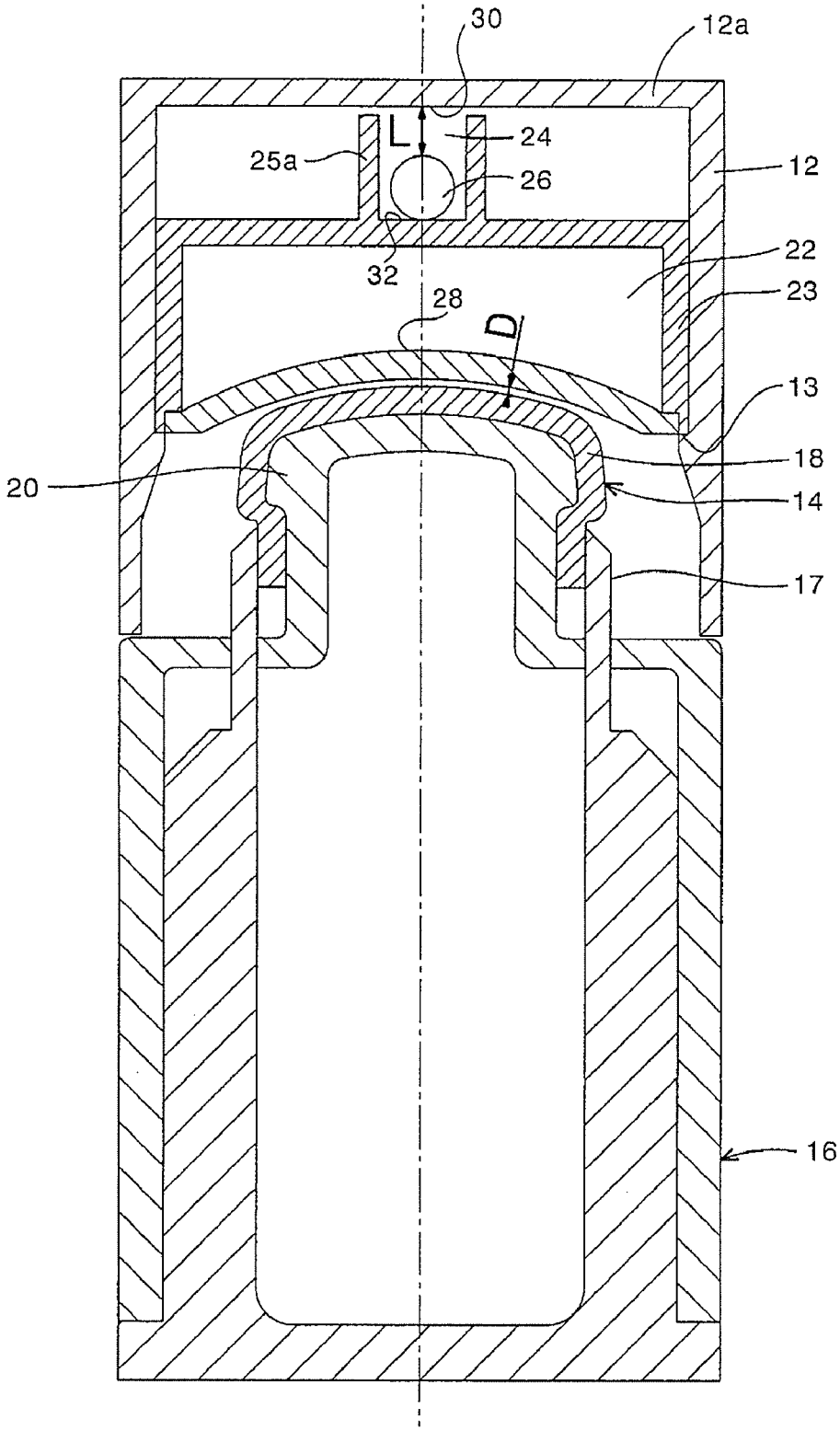
FIG. 1 shows a configuration by way of example in accordance with a first embodiment of an applicator device having an impact ball for impact production.

FIG. 1 shows a configuration by way of example of an applicator device in accordance with the first embodiment. The applicator device substantially comprises a sleeve 12 forming the housing, a holding portion or handle portion 16 on which a flat or areal applicator 14 is disposed, with an applicator surface 18 which is held by means of a tongs-like holder 17 and which is formed by a flat surface portion which is stretched over a fixed support 20 which is a part of the handle portion 16.

The applicator 14 can alternatively be manufactured by holding hairs in the form of a brush or as in FIG. 1 in the form of a flat areal applicator comprising a fabric, foam, leather, artificial leather or sponge rubber which are fixed to the handle portion by a clamping means such as for example a clamping clip. An applicator which is manufactured by flocking of a carrier material or with two-component injection molding procedures is also a possibility. As the design configuration of the applicator itself and the manufacture thereof are not essential to the principle set forth herein of a metering mechanism which is integrated into the applicator device, a detailed discussion of the applicator will be dispensed with, in the embodiments discussed hereinafter.

A rigidly arranged storage container 22 is disposed in the sleeve 12 as the storage means for accommodating the loose substance. Outside the storage container 22 functioning as the storage means and still within the sleeve 12 forming the housing there is a hollow space 24 which is formed by a tubular portion 25*a* and which is disposed outside, with respect to the interior of the storage container 22, which interior forms the storage means for the powder, while an impact ball 26 is arranged as the impact body in the hollow space 24.

The storage container 22 has a wall 28 which is permeable for the loose substance. The permeability of the wall can be embodied for example by the permeable wall comprising a mesh-like or lattice-like material, a woven material or also a non-woven material such as a fleece or alternatively an apertured or perforated material.

As already discussed hereinbefore the permeability of the wall 28 in relation to the loose substance can be adjusted at the production end by means of suitable dimensioning of the mesh width of the wall which is structured in a mesh-like fashion or in the case of an apertured wall the corresponding dimensioning of the holes by way of the effectively operative opening area of the holes and the density (distribution) of the holes (that is to say holes per unit of surface area) in the wall 28. Regular use of the applicator device insofar as concerns the integrated metering function will be briefly described hereinafter.

In the closed condition (storage condition) of the applicator device the handle portion 16 is fitted with the applicator 14 into the sleeve 12, the applicator 14 being disposed with its surface in opposite relationship to the permeable wall 28. In that situation the handle portion 16 can be secured in the sleeve 12 by way of a suitably designed releasable connection to prevent unintentional opening of the applicator device. A releasable but nonetheless secure connection of that kind can be of any desired configuration and should not be deemed to constitute a problem at this juncture. In that respect it should just be mentioned that the connection may for example involve a screw connection, a bayonet connection, a plug connection using a suitably adjusted frictional engagement or a snap-action connection with a suitably designed positively locking engagement, the respective technical implementation of which however does not represent any particular technical problem to the man skilled in the art.

In the closed condition of the applicator device a male or female user, by means of the integrated metering function, can provide for loading of the applicator surface with a given amount or dose of the powder from the storage container 12, in a fashion which can be very substantially identically reproduced. For that purpose the applicator device, in the FIG. 1 configuration, is shaken, whereby the mass moment of inertia of the impact ball 26 provides that the ball 26 can be accelerated in its hollow space 24 along the maximum available free travel distance L (with respect to the reference system formed by the hollow space). When the impact ball 26 hits against the respective ends 30, 32 of the hollow space 24 impacts are produced by the impact ball 26 at respective ends 30, 32 of the hollow space 24.

The impacts produced in that way transmit impulses to the sleeve 12 or the wall of the storage container 22. As a result, the storage container 22 and also the wall 28 which is connected thereto and which is permeable to the powder is caused to shake or vibrate, that is to say it is subjected to an impact loading. As a consequence of one or more impacts produced in that way, the predetermined, that is to say pre-set, permeability of the wall 28 together with the properties of the particles of the powder, cause a predetermined amount thereof to be transferred on to the surface of the applicator 14 from the storage container 22. In other words the applicator surface 18 is loaded with an amount of powder, which is essentially predetermined by the shaking movement.

It should also be particularly mentioned here that the maximum amount of powder which can be loaded out of the storage container 22 on to the applicator 14 can be established, that is to say pre-set, by virtue of suitable dimensioning of the distance D of the applicator surface 18 relative to the permeable wall 28 of the storage container 22 in the closed condition of the applicator device. That makes it possible to avoid overdosing by for example excessively long shaking of the applicator device or unintended metering dosing procedures for example while the applicator device is being transported in a handbag. Additionally or alternatively distribution of the loose substance on the applicator can also be influenced by way of the above-mentioned distribution of the permeability of the wall 28, which is set at the production end. Thus for example the powder can be loaded on to the applicator surface in the form of a small heart.

In this connection it should further be noted that the distance D marked in FIG. 1 does not have to be the same at all locations between the wall 28 and the applicator surface 18, but in principle can be varied as desired. In other words: the pre-set maximum amount of powder which can be loaded on the applicator can also be established by way of the volume of the space enclosed by the applicator surface 18 and the permeable wall 28. By way of example a loading on the applicator surface 18 which is of differing thickness can be achieved by a suitable configuration in respect of the pattern of the distance D. These comments on the question of the distance D can basically be implemented in regard to all embodiments described herein.

In regard to the structure of the applicator device shown in FIG. 1 it should also be mentioned that the storage container 22 is formed by an insert 23 which is fitted into the sleeve 12 upon manufacture of the applicator device, wherein its position in the sleeve 12 is determined at the lower end (that is the end with the permeable wall 28) by an abutment 13 or projection which is provided at the inside surface of the sleeve 12 and which is continuous or which is also of a point-form configuration or of a portion-wise configuration, while at the other end the position of the sleeve 12 is determined by way of an end cap 12*a* for the sleeve 12. In that structure the insert 23 is supported at the inside surface of the end cap 12*a* with the upper edges of the tubular portion 25*a* which forms the hollow space 24 and which is in one piece with the insert 23.

With that structure the storage container 22 can be filled by the manufacturer of the cosmetic product, thereafter closed by means of the permeable wall 28, in which case it can be specifically matched in respect of its permeability to the particle properties of the powder, and thereafter fitted into the sleeve 12 forming the housing. After the impact ball 26 has been introduced into the hollow space 24 both the hollow space and also the sleeve 12 are permanently closed with the end cap 12*a*, whereby both the insert 23 and also the impact ball 26 are secured to prevent them from falling out.

Figure 2:
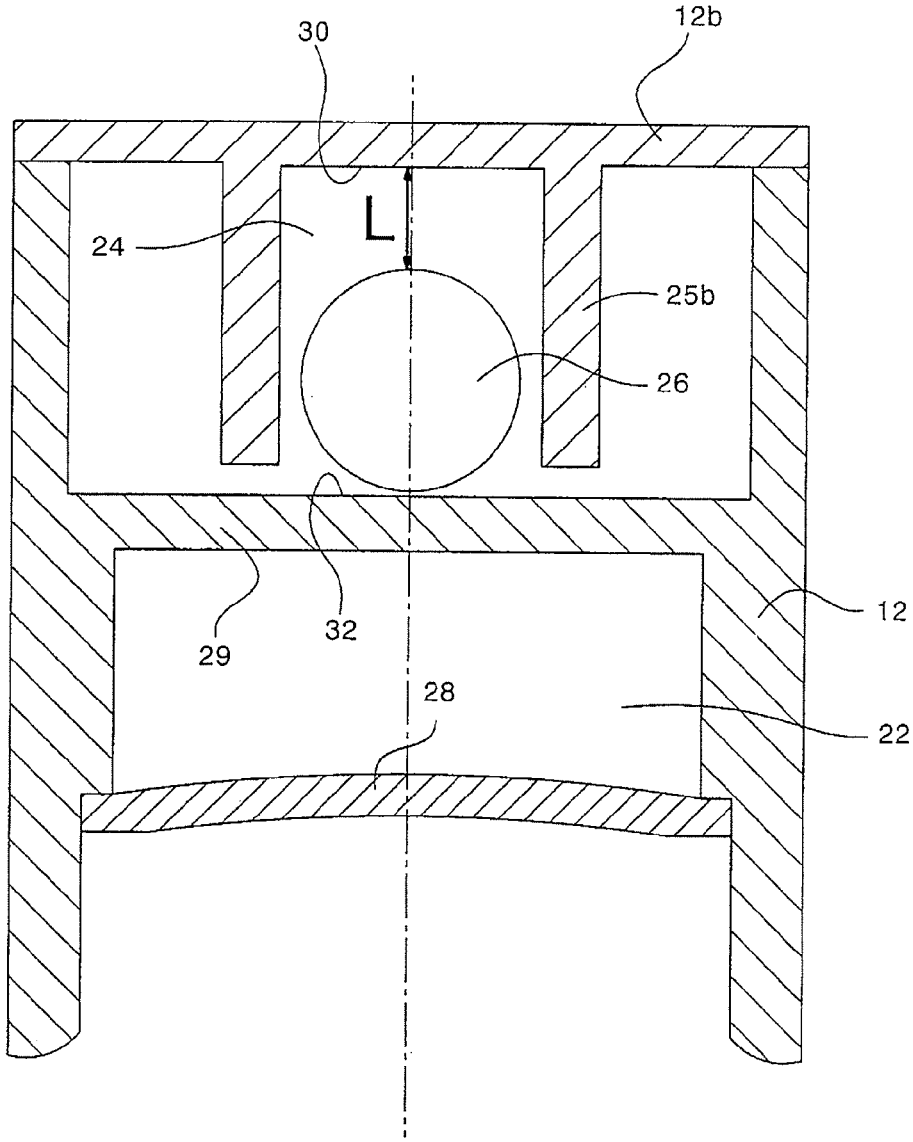
FIG. 2 shows an alternative configuration by way of example of the first embodiment.

FIG. 2 shows a part of an alternative structure of an applicator device in the region of the housing forming the sleeve 12, in particular an alternative configuration of the storage container 22 and of the hollow space 24 for the impact ball 26. Hereinafter only the differences in comparison with FIG. 1 are described in greater detail.

As a difference in relation to FIG. 1 the sleeve 12 of the applicator device, that forms the housing, has a storage container 22 for the cosmetic powder, which is fixedly integrated into the interior of the sleeve 12. Similarly to the embodiment of FIG. 1, at its lower end the storage container 22 is closed by means of the wall 28 which is permeable for the loose substance. At the upper end of the storage container 22, that is to say after an intermediate wall 29 in opposite relationship to the permeable wall 28, the sleeve 12 is continued beyond that upper intermediate wall 29 with the edges thereof, thereby forming a cup-like space as the sleeve end. In other words, in the embodiment of FIG. 2 the storage container 22 is formed by the outer sleeve 12, the intermediate wall 29 and the permeable wall 28.

On its side which faces into the sleeve 12, an end cap 12*b* as an end closure for the sleeve 12 has a tubular portion 25*b* which is arranged in centered relationship with the longitudinal axis of the sleeve 12 and which is closed at its upper end by the cover 12*b* and which is closed downwardly by the intermediate wall 29, in the condition of being fitted into the sleeve 12. Similarly to FIG. 1 the tubular portion 25*b* forms the hollow space 24 for accommodating the impact ball 26. Alternatively, if an end cap 12*b* without a tubular portion 25*b* is used, the impact ball can also be arranged in the space which is formed in a cup-like configuration by the sleeve end.

The impact ball 26 serves for producing the impact for the integrated metering function. By shaking the applicator device, with each impact of the impact ball 26 against one of the ends 30, 32 of the hollow space 24, impacts or impulses are transmitted to the storage container 22 and thus also to the permeable wall 28, that is to say the permeable wall 28 is also shaken or caused to vibrate and thus a certain amount of powder is delivered downwardly in the direction of the applicator (not shown in FIG. 2) arranged there and the applicator is thus loaded in a metered fashion.

Figure 3:
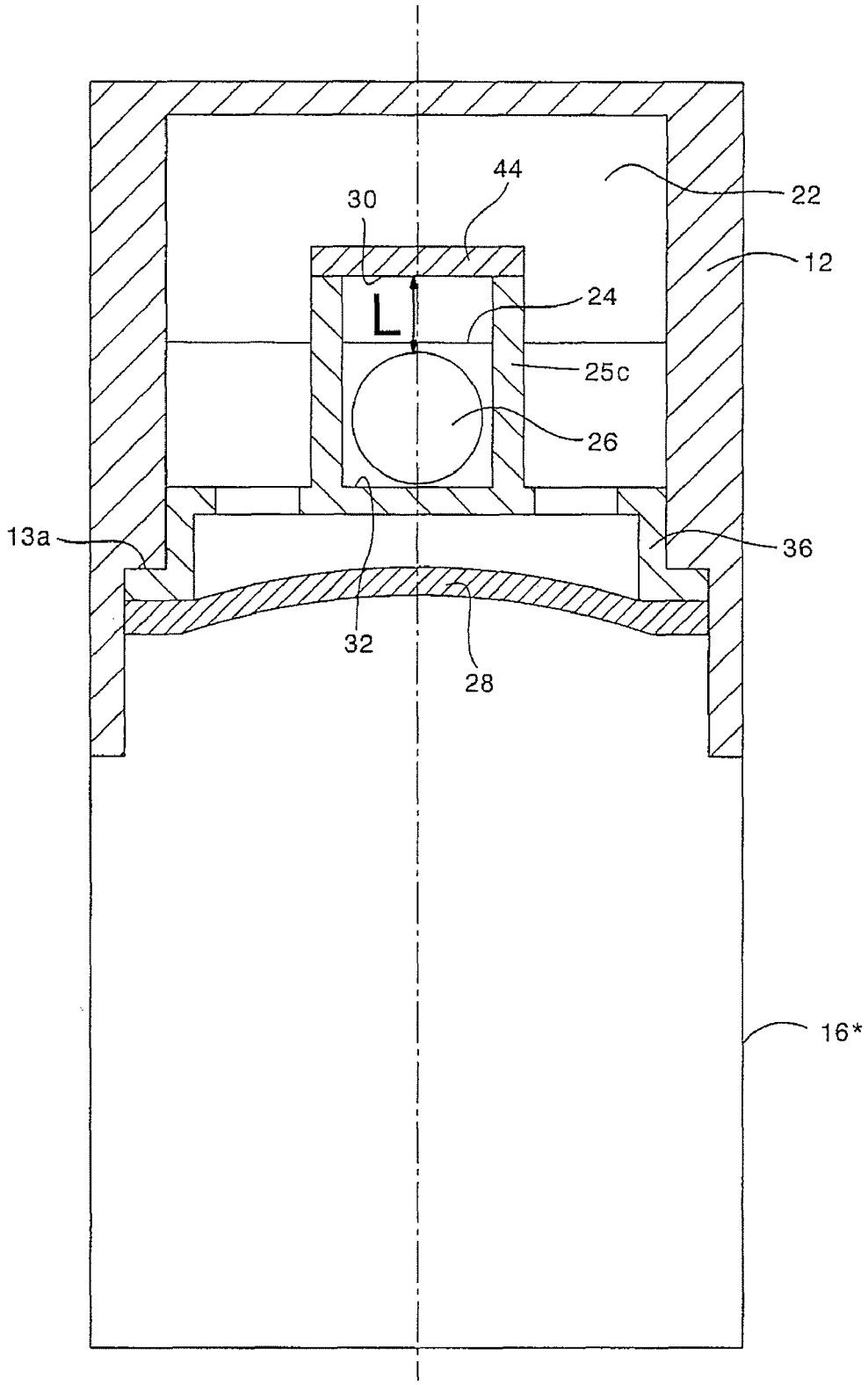
FIG. 3 shows a further alternative configuration by way of example of the first embodiment.

FIG. 3 shows a further possible arrangement of the impact ball 26. The hollow space 24 for the impact ball 26 is arranged centrally in relation to the sleeve 12 in the lower part of the storage container 22. On a side of the storage container 22, that is towards the permeable wall 28, a carrier element 36 is fitted into the sleeve 12, and is supported from below in the sleeve 12 against or on an abutment 13*a* or projection which is formed at the inside of the sleeve 12 (the abutment or projection being continuous or also being of a point-form configuration or portion-wise configuration). The carrier element 36 carries centrally in relation to the sleeve 12 a tubular portion 25*c*, the lower end 32 of which is formed by the carrier element 36 and is closed and the upper end 30 of which is closed by a cap 44, whereby the tubular portion 25*c* thus forms the hollow space 24 for the impact ball 26.

Upon actuation, in accordance with the invention, of the applicator device, the applicator device is shaken as already described hereinbefore and in that case the one metering impact or the plurality of metering impacts is or are produced, using the mass moment of inertia of the impact ball 26. The impulses produced by the impacts are transmitted to the carrier element 36 and thus, as can be seen from FIG. 3, by way of the edges of the carrier element 36, which bear against the sleeve 12 at the inside surface thereof, to the permeable wall 28 which is in contact there. Thus metering actuation in the appropriate fashion causes a part of the powder in the storage container 22 to be delivered through the permeable wall 28, that is to say loaded on to the applicator (not shown in FIG. 3). In FIG. 3 the outline of a handle portion with applicator, which is inserted into the sleeve 12 at the bottom thereof, is only symbolically indicated by reference numeral 16*.

Figure 4:
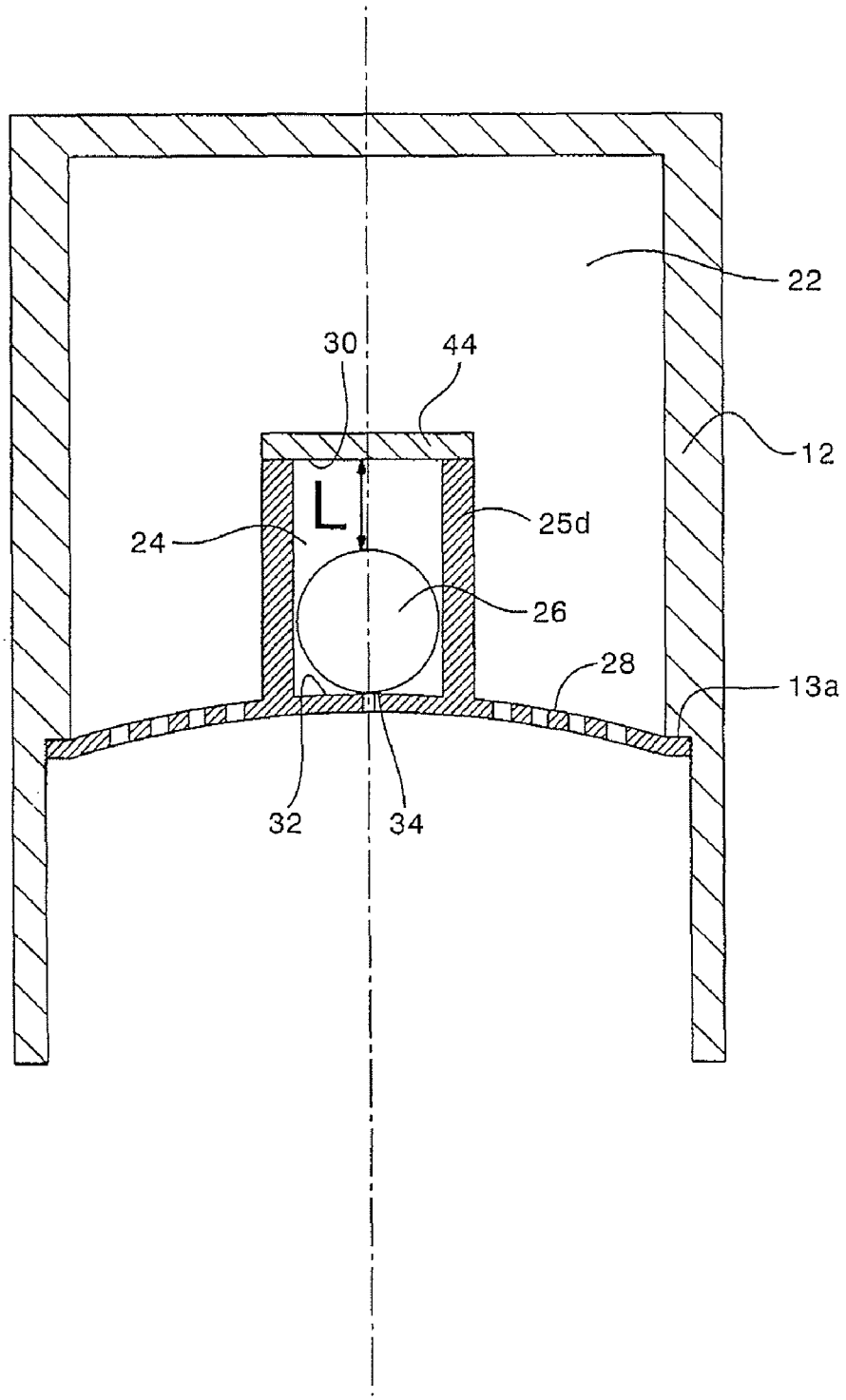
FIG. 4 shows a development of the configuration of FIG. 3 in which the hollow space for the impact ball is connected to the permeable wall of the storage means.

FIG. 4 shows a development of the embodiment illustrated in FIG. 3. In comparison with FIG. 3, this structure involves a simplification insofar as the tubular portion 25*d* forming the hollow space 24 for the impact ball 26, in the arrangement of FIG. 4, is disposed directly and in central relationship with the sleeve 12 fixed to the permeable wall 28 or forms a unit with the wall 28.

At its end 32 which is towards the permeable wall 28 the tubular portion 25*d* is closed by the wall 28 while at the opposite end 30, as in FIG. 3, it is closed for example by means of a cap 44, so that the impact ball 26 cannot pass into the storage container 22 from the hollow space 24. The wall 28 forming the lower end 32 of the hollow space can also have a vent bore 34 in order to prevent fluctuations in internal pressure in the hollow space 24, for example due to fluctuations in temperature. It will be appreciated that the tubular portion 25*d* can be made in one piece with the permeable wall 28, using a shaping method.

Figure 5:
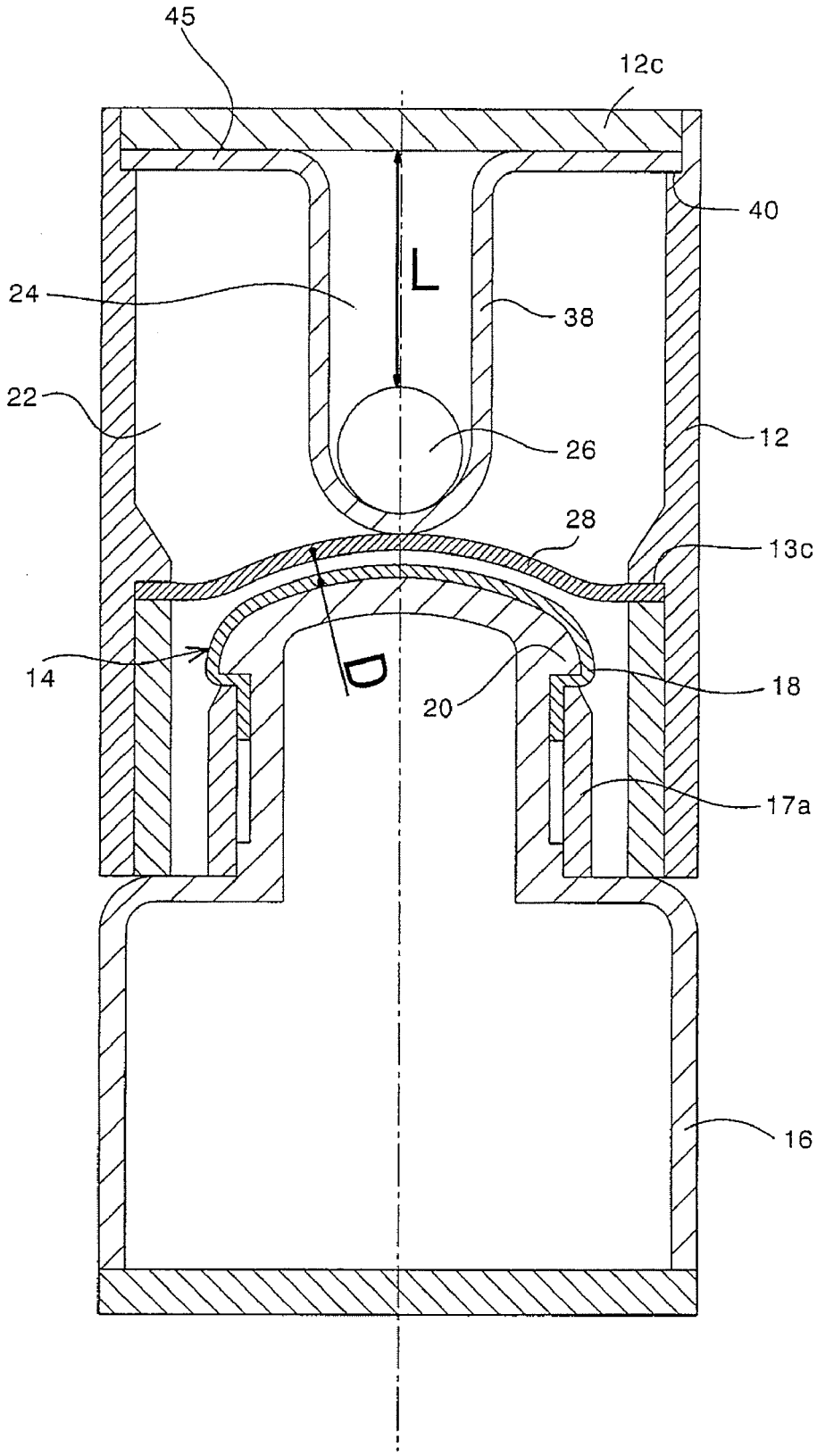
FIG. 5 shows an alternative construction of the configuration of FIG. 4, wherein the hollow space for the impact ball is in contact with the permeable wall of the storage means.

In contrast to FIGS. 3 and 4 FIG. 5 shows a design in which the hollow space 24 for the impact ball 26 is of such a configuration that it extends from the upper edge of the storage container 22, with its downwardly closed end, to the permeable wall 28, that is to say it is in contact there with the wall 28. In that way the impacts which are produced with the impact ball 26 when the applicator device is shaken can be transmitted directly on to the permeable wall 28 for the purposes of metered loading of the applicator 14.

The hollow space 24 for the impact ball 26 in FIG. 5 substantially comprises an elongate tube 38 which is closed at the end towards the wall 28 and which, at its end remote from the wall 28, has a collar 45 which is of such a dimension that it fits into the upper end of the sleeve 12 in order to close the storage container 22. For that purpose the sleeve 12 once again has an edge 40 extending peripherally on the inside of the sleeve 12, for fixing the tube 38 in the sleeve 12 by way of the collar 45. To close the hollow space 24 the sleeve 12 of the applicator device is again closed at its end by means of a cover 12*c*. The maximum free travel distance for the impact ball 26 disposed in the hollow space 24 is again identified by L. Here it should be noted once again that the strength of the impacts or impulses which can be produced, over the travel distance L, and the properties of the impact ball 26, can be adjusted at the production end.

At this juncture attention should also be directed to a further aspect which can be clearly seen in FIGS. 1 through 5, namely that the shape of the permeable wall 28 substantially follows the shape of the applicator surface 18 which is arranged in adjacent relationship in the closed condition of the applicator device or is shaped to provide a corresponding predetermined configuration in respect of the distance D between the applicator surface 18 and the permeable wall 28.

Figure 6:
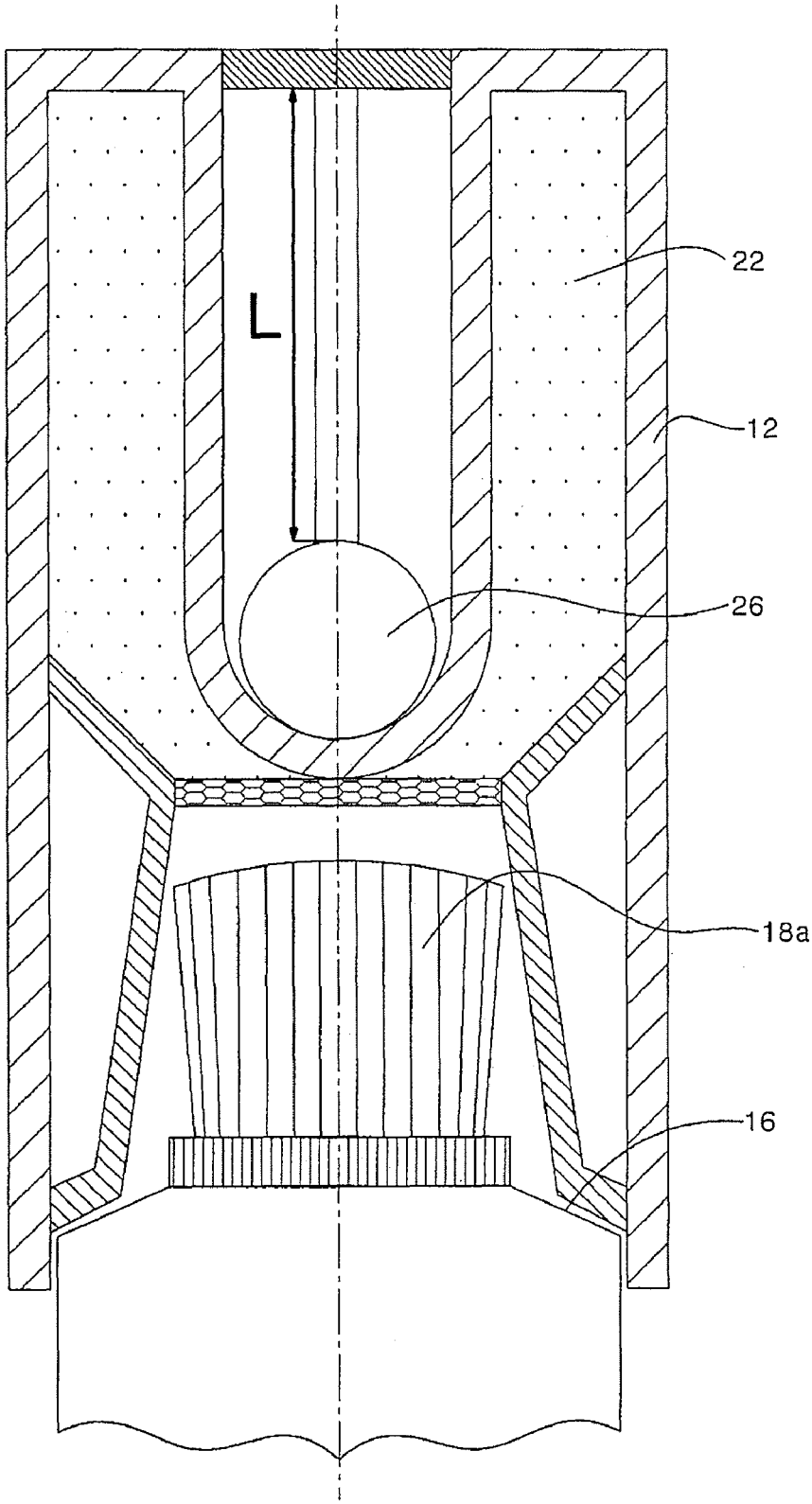
FIG. 6 shows an alternative design of the configuration of FIG. 5, wherein the applicator is in the form of a brush.

FIG. 6 shows a further embodiment of an applicator device, the applicator here being in the form of a brush 18*a* instead of being of a flat surface form. The operating principle for production of the impacts according to the invention for metered discharge of the powder from the storage container 22 on to the brush 18*a* is basically identical to that shown in FIG. 5 and therefore does not need to be described in detail here.

Attention will however also be explicitly directed here to a particularity of the embodiment of FIG. 6. The cosmetic powder is here loaded directly on to the tips of the hairs of the brush 18*a* and not on to the side surfaces, that is to say the outer hairs of the brush, as happens when a pressed powder is taken with a brush from a bowl. That facilitates specifically powdering selected parts of the skin and the edge hairs of the applicator, which have 'remained clean', can be used for blending in the powder. It should also be noted here that powder brushes are known in which loading is effected 'from the back', that is to say from the side of the holding portion or handle portion 16. Such a design configuration however entails a high dust potential. It should be pointed out that all conceivable applicator variants can be used in principle in relation to all embodiments described herein of the applicator device according to the invention.

Figure 7:
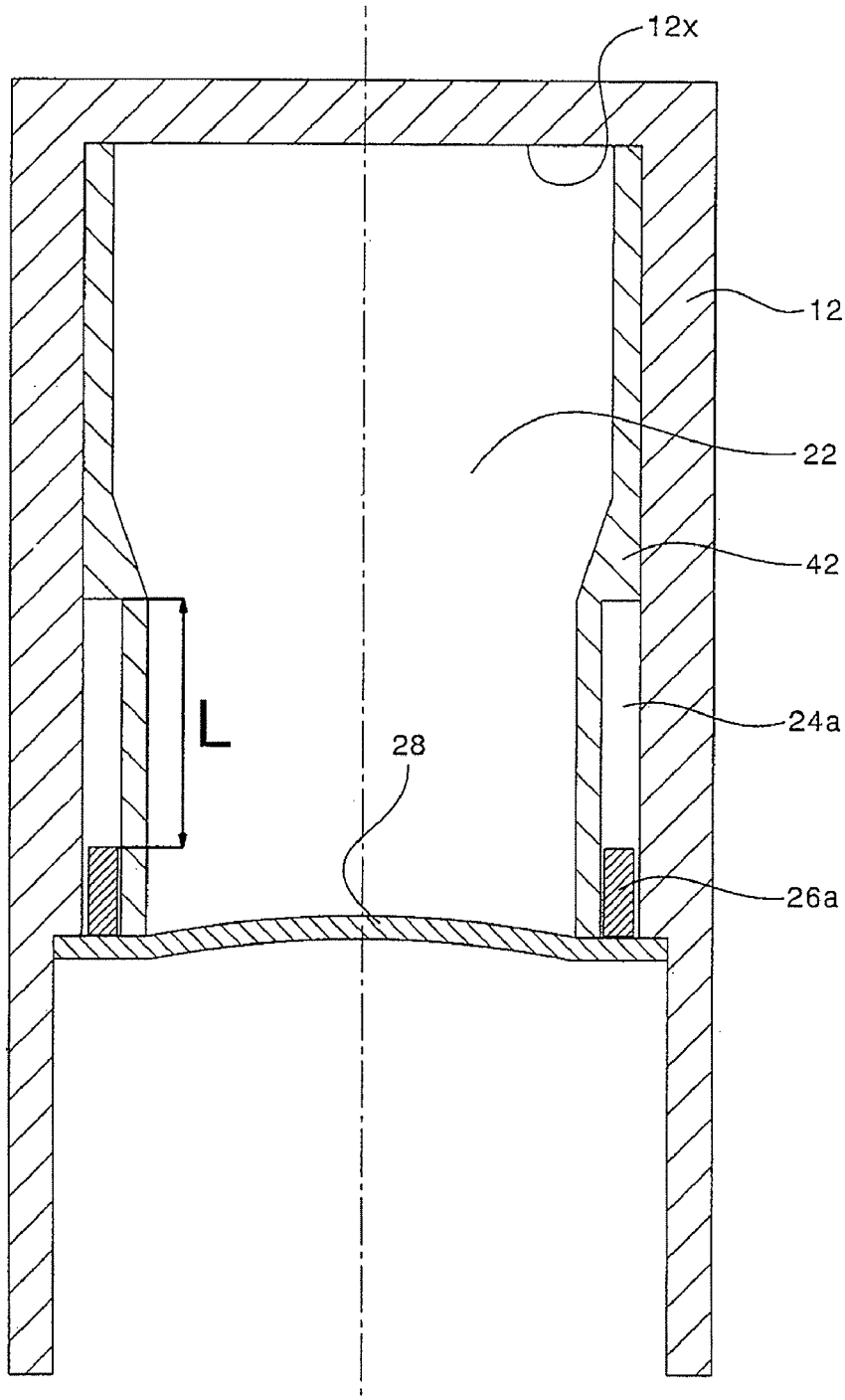
FIG. 7 shows a further configuration by way of example of the first embodiment with an annular impact body and a hollow space of corresponding configuration for same.

As regards the form of the impact body, it basically does not have to be round—like the impact ball 26 of the embodiments in FIGS. 1 through 6—but in principle can be of any desired geometrical shape. FIG. 7 in that respect shows as an example an alternative configuration for an impact body, namely an impact ring 26*a*.

In the embodiment of FIG. 7 the impact ring 26*a* surrounds the storage container 22. For that purpose disposed in the sleeve 12 forming the housing of the applicator device is an insert 42 which bears against the upper inner end 12*x* of the sleeve 12 and which is extended downwardly in the direction of the permeable wall 28. At approximately the middle of the height of the storage container 22 the insert 42 which is itself in the shape of a cylinder extends at a spacing relative to the inside wall of the sleeve 12 so that there is an annular hollow space 24*a* between the inside wall of the sleeve 12 and the insert 42. Arranged in that hollow space 24*a* is the impact ring 26*a*, the function of which, for producing the impacts according to the invention, is substantially identical to the above-described structures with the impact ball 26, wherein the impact ring 26*a* in the embodiment of FIG. 7 directly applies impacts to the edge of the wall 28 at the lower end of the annular hollow space 24*a*, that is to say the side that is towards the permeable wall 28, when the applicator device is shaken, in which case the impact ring transmits impulses to the permeable wall 28 and can thus cause it to be shaken or vibrated. It will be appreciated that the sleeve 12 and the insert 42 can also be formed in one piece.

As already described in detail in connection with the impact ball, the maximum free travel distance L for the impact ring 26*a* in the hollow space 24*a* can in principle be extended to the internal height of the storage container 22, as a parameter for dimensioning of the impacts which can be produced in the FIG. 7 embodiment.

Although this is not shown in FIG. 7, it is also possible to provide above the storage space 22 a hollow space which for example can be equipped with an axially freely movable plate or also a bar as the impact body without a specific additional housing or a hollow space as shown in FIGS. 1 through 7 being required for that purpose.

Figure 9:
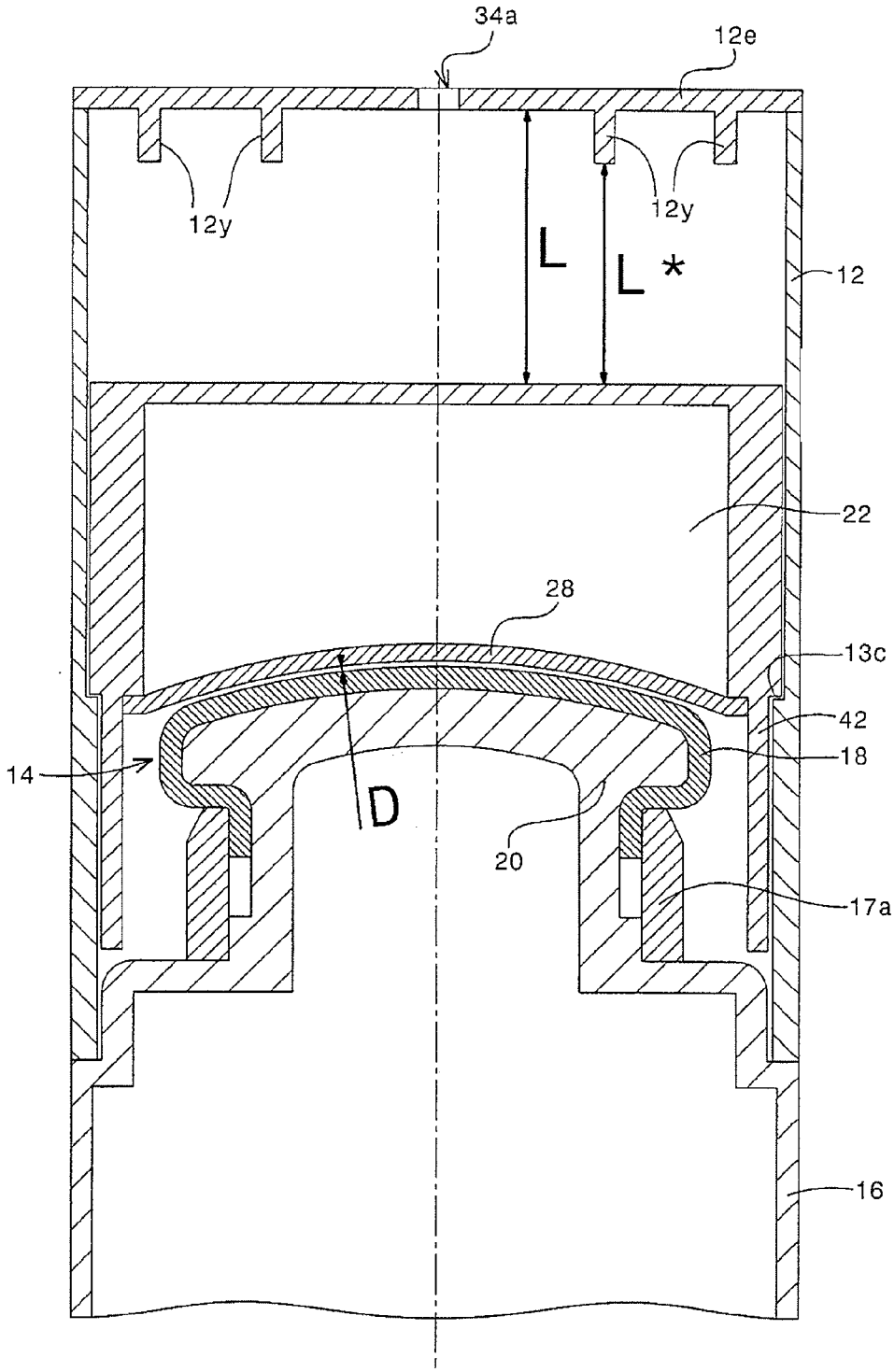
FIG. 9 shows an alternative design of the first configuration in accordance with the second embodiment with reduced soiling of the internal space.
Figure 10:
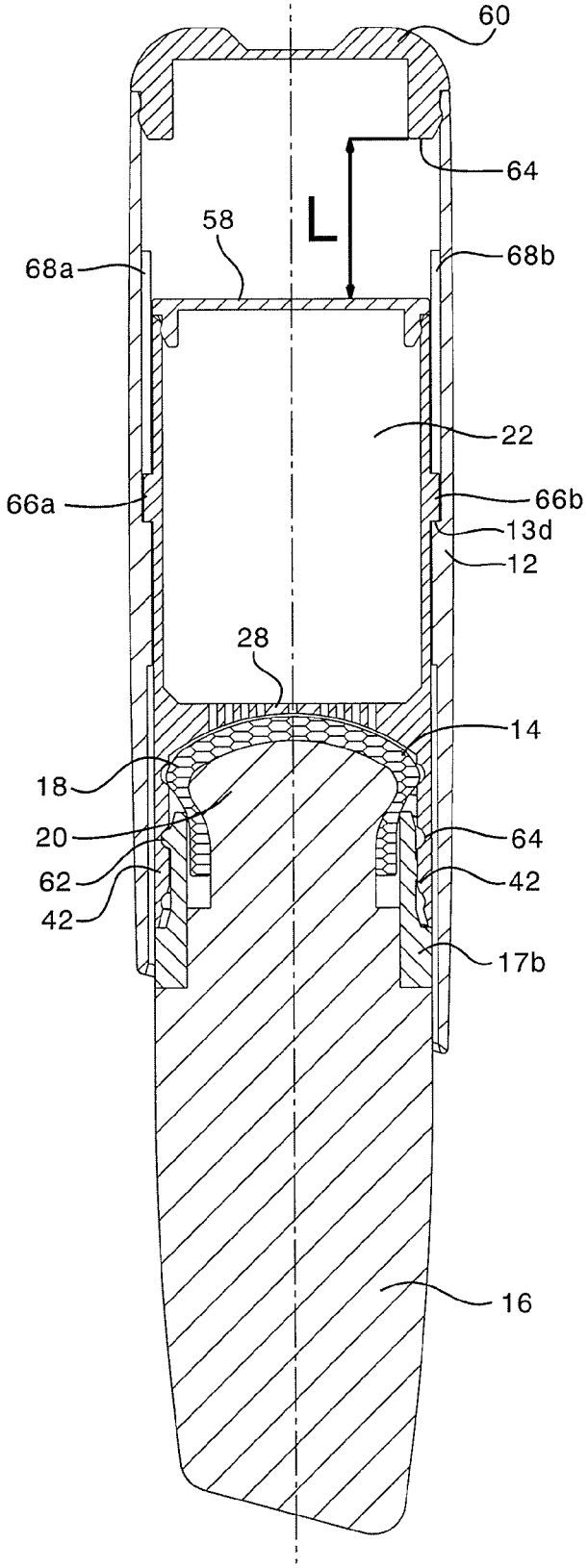
FIG. 10 shows a second configuration of an applicator device in accordance with the second embodiment.

In accordance with the second embodiment of the invention, instead of an impact body which is integrated into the housing of the applicator device for producing one or more impacts, a storage container 22 which serves as a storage means is itself used as the impact body. In other words, an impact required to produce the metering delivery of powder is produced by the storage container 22 which is freely movable in the sleeve 12 substantially axially (with reference to the longitudinal axis of the sleeve 12 forming the housing) striking or abutting against an abutment 13*b* in the sleeve 12, which is provided at the inside of the sleeve 12 and which extends continuously peripherally or which is of a point-form or portion-wise configuration. Configurations by way of example of this second embodiment are shown in FIGS. 8 through 10 and are described hereinafter.

Figure 8:
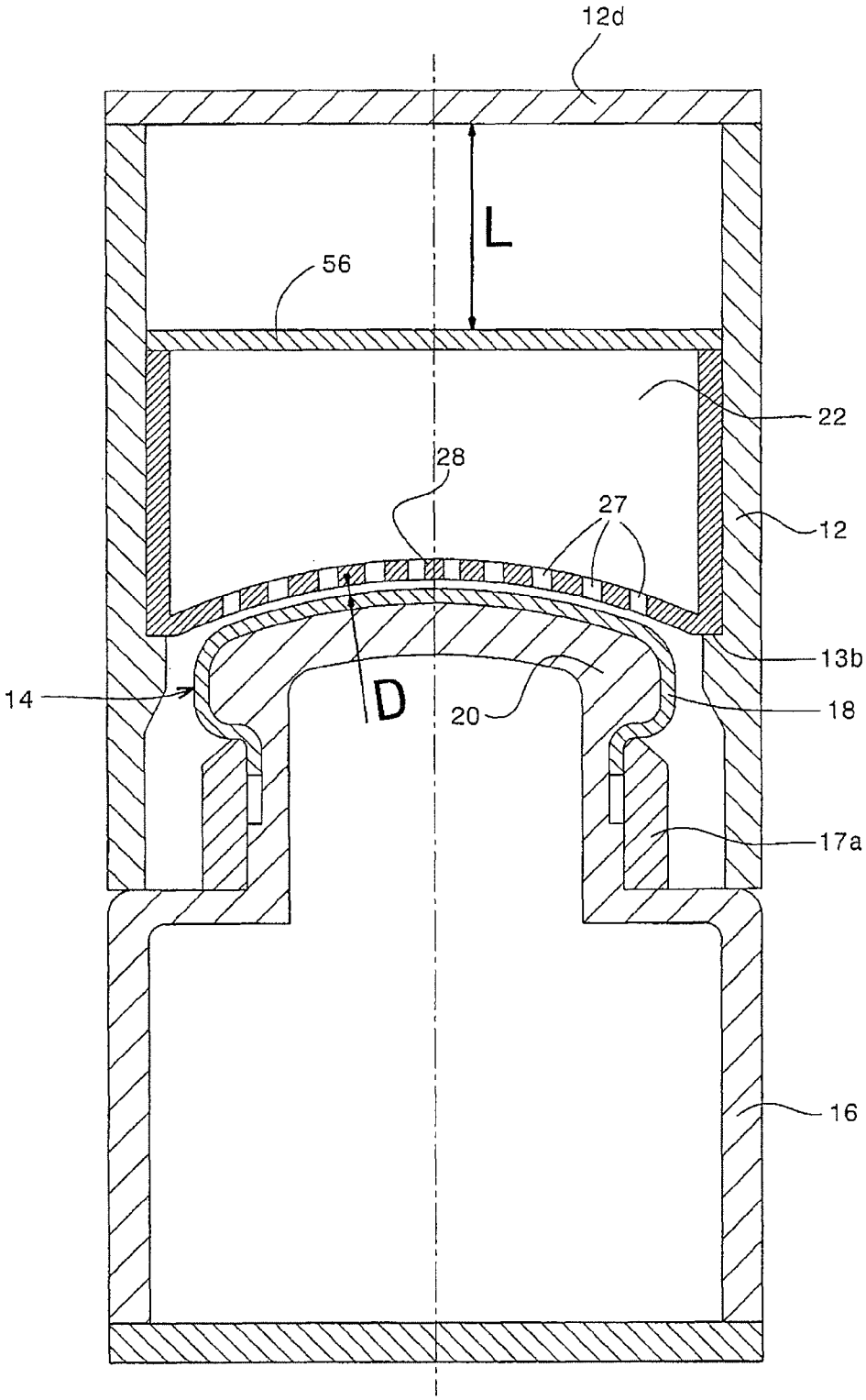
FIG. 8 shows a first configuration by way of example of the second embodiment of an applicator device with movable storage container as an impact body for impact production.

The embodiment shown in FIG. 8 substantially corresponds to the embodiment of FIG. 5 in regard to the configuration of the handle portion 16 and the applicator 14 fixed thereto. The flat surface material 18 forming the applicator 14 is held fast or clamped fast in position by means of a clamping ring 17*a* on the fixed support 20 which is formed in one piece with the handle portion 16.

The essential difference in the embodiment in FIG. 8 with respect to the embodiments of FIGS. 1 through 7 is in particular that no extra impact body in the form of the impact ball 26 (FIGS. 1 through 6) or the impact ring 26*b* (FIG. 7) is used, but now the storage container 22 which is arranged in and movably with respect to the sleeve 12 forming the housing itself serves as the means for producing the impacts according to the invention.

For that purpose the storage container 22 is arranged in the sleeve 12 movably over a maximum free travel length L in the sleeve 12, wherein the lower abutment 13*b* at the inside surface of the sleeve 12 serves to limit the travel length downwardly as viewed from the cover 56 of the storage container 22 in the direction of the applicator 14 and a cover 12*d* which closes the sleeve 12 serves to limit the travel length upwardly at the end of the sleeve 12. Holes 27 are provided in the permeable wall 28 of the storage container 22.

If now the applicator device is shaken in the closed condition, that is to say the sleeve 12 is connected to the handle portion 16 and the applicator 14 is arranged in the interior in adjacent relationship with the permeable wall 28, the storage container 22 can be accelerated by virtue of its mass moment of inertia with respect to the reference system defined by the sleeve 12. The available travel length L for acceleration purposes is predetermined, as discussed hereinbefore, by means of limiting means formed by the cover 20*d* of the sleeve 12 at one end and by the abutments 13*b* at the other end.

Whenever the storage container 22 strikes or impacts against one of those limiting means, the storage container 22, as the impact body, is abruptly decelerated and as a result is loaded or acted upon with an impact. In other words, in terms of the effect on the storage container 22, it does not make any difference whether an impact body directly or indirectly transmits impulses to the storage container 22 or whether the storage container itself serves as the impact body and thus serves as the means for impact production. As a result the permeable wall 28 of the storage container 22 is shaken or caused to vibrate and thus a given amount of cosmetic powder is loaded on to the applicator 14, similarly to the function of a salt or pepper shaker.

As differences in relation to the embodiment of FIG. 8, FIG. 9 shows side walls 42 on the storage container 22, which are prolonged parallel to the wall of the sleeve 12 beyond the permeable wall 28 in the direction of the inserted applicator 14. The side walls 42 give rise to a lower degree of susceptibility to soiling for the handle portion 16 in the proximity of the applicator 14 by the powder. In addition that improves or ensures axial mobility of the storage container 22 over the period of use of the applicator device.

In addition FIG. 9 shows an alternative possible way of setting the maximum free travel distance for the storage container 22 to function as the impact body. Legs 12*y* on the cover 12*e* of the sleeve 12 provide that the limited free travel distance L* is set in the manufacturing procedure, in comparison with the maximum possible free travel distance L without legs 12*y*. Disposed in the cover 12*e* is a vent opening 34*a*, by means of the dimensioning of which, that is to say the effective cross-section, it is additionally possible to influence the acceleration effect on the storage container 22 by virtue of the applicator device being shaken.

In accordance with the second configuration by way of example of the second embodiment the holding portion or the handle portion 16 and the storage container 22 can both be releasably connected—as shown in FIG. 10—and connected in that way can be arranged movably in the sleeve 12 forming the housing of the applicator device, so that the integrated metering mechanism described herein is operative when the applicator device is shaken.

FIG. 10 shows an applicator device with a holding portion or handle portion 16 which can be detached or withdrawn. It should also be noted in this connection that the question of whether the handle portion 16 is hollow or solid or is designed in some other form is essential to the present invention only insofar as the overall mass of the handle portion, in the embodiment of FIG. 10, is involved as a parameter in respect of impact production.

In the connected condition, that is to say when the applicator device is closed, the storage container 22 and the handle portion 16 are arranged movably in the sleeve 12 which functions as the housing, in which respect provided on the storage container 22 are lateral guides 66*a* and 66*b* which are in engagement with respective corresponding guides 68*a* and 68*b* in the inside surface of the sleeve 12 and are guided in such a way that axial rotation of the storage container 22 with respect to the sleeve 12 is prevented. It is possible in that way to establish an arrangement, which is desired for example for design reasons, of the handle portion 16 with respect to the sleeve 12, when the applicator device is in the closed condition.

Formed on the handle portion 16 in one piece therewith is a pre-shaped support 20 for the flat surface applicator 14, wherein the application surface 18 is stretched over the support 20 and is held in place by means of a clamping ring 17*b*. Disposed at the peripherally extending surface of the clamping ring 17*b* is a correspondingly peripherally extending thread flight of a male screwthread 62 which co-operates with a corresponding thread flight of a female screwthread 64 in the prolonged side walls 42 of the storage container 22 and thus, as a screw connection, permits a releasable connection to be made between the handle portion 16 and the storage container 22. Alternatively, in place of the screw connection, it is also possible to use a latching or snap-action connection in which a projection which extends in continuous peripheral relationship or which is of a point-form or portion-wise configuration can be disposed as a snap-action nose for example at the peripherally extending outside surface of the clamping ring 17*b*, wherein the projection can be in engagement with one or more corresponding recesses in the prolonged side walls 42 of the storage container 22, in which case the co-operation of the snap-action nose with the recess would form a releasable connection between the handle portion 16 and the storage container 22, in the form of a snap-action closure. Finally the releasable connection can also be designed on the basis of the principle of a bayonet connection or simply by way of frictional engagement in the form of a plug connection.

The cosmetic powder, with appropriate shaking of the applicator device, can issue under the effect of the impacts produced, by way of the wall with passageways therethrough, that is to say the wall 28 of the storage container 22, which is permeable for the powder and which is towards the applicator 14, and can thereby load the applicator surface 18.

As already described on a number of occasions hereinbefore the permeable wall of the storage container can be of or made in a mesh-like or sieve-like configuration consisting of metal or plastic material. It will be appreciated that other materials or combinations of various materials are also conceivable.

Alternatively—as in FIG. 10—the permeable wall 28 is formed by an apertured (perforated) wall 28, wherein the wall 28 of the storage container 22 is made in one piece therewith but can also be assembled separately as an individual part with the remainder of the storage container 22. The design involving two parts is advantageous when a different material is to be used for the storage container 22, than the material for the permeable wall 28. In that case the opening in the storage container 22, which is provided for the permeable wall, can be used for filling the storage container 22, that opening then being closed with the permeable wall 22.

In the embodiment shown in FIG. 10, it is possible for the storage container 22 to be filled 'from the back', that is to say through the rear side of the storage container 22, which is in opposite relationship to the permeable wall 28. After being filled with powder the storage container 22 is closed with a cover 58 which can be fixed to the storage container 22 as desired. The cover 58 can be fixed for example by means of adhesive or welding in material-locking relationship but alternatively also can be fixed in form-locking relationship by means of a clamping connection or a snap-action connection. The sleeve 12 forming the housing is closed by a cap 60 after the storage container 22 has been inserted into the sleeve 12.

Optionally it is also possible to dispense with the cap 60 and the cover 58 or also a part of the storage container 22 can project as a visible part (visible portion) out of the sleeve 12. For that purpose the storage container 22 can be arranged axially movably by way of latching tongues in corresponding apertures in the sleeve 12. That has the advantage that the number of parts is reduced.

In the embodiment shown in FIG. 10 the annular end faces 64 of the cap 60, which protrude into the sleeve, also form an end abutment for the axially movably arranged storage container 22 when producing the metering impacts or impulses. In FIG. 10 the maximum free travel distance for acceleration of the storage container 22 has again been identified by L.

It should also be noted in this respect, as usually the applicator device is not produced by the manufacturer of the cosmetic powder, that the pre-assembled applicator devices can be supplied to the cosmetic manufacturer, in which case the two functional parts consisting of the handle portion 16 with applicator 14 and the storage container 22 are already releasably connected together, whereby the permeable wall 28 of the storage container 22 is closed with the applicator 14. After the storage container 22 is filled at the back as already described hereinbefore, the unit consisting of the handle portion 16 with storage container 22 is fitted into the sleeve 12 and the latter is then closed with the cap 60. In terms of fixing the cap 60 to the sleeve 12, essentially the same considerations apply as in regard to the cover 58 for the storage container 22.

The present invention has disclosed an applicator device for a loose substance, in particular a cosmetic substance such as a cosmetic powder, comprising at least one housing having a storage means for the substance and a handle portion on which is disposed an applicator which in the closed condition of the applicator device is arranged in the interior of the housing in the direction of the storage means, wherein a wall of the storage means, that is towards the applicator, is provided with passageways for the loose substance, and there are provided means for producing at least one impact on at least one part of the storage means so that a part of the loose substance can be loaded on to the applicator through the permeable wall of the storage means by metering impacts.

Shaking of the closed applicator device causes the production of pre-set impacts, by means of which, by way of a wall of the container which is permeable for the loose substance to be applied, the applicator which is arranged on the other side of the wall can be loaded with an optimum metered dose of the substance. It is particularly advantageous for the metering operation to be linked to a noise which represents an acoustic feedback for the male or female user in terms of the applicator loading operation.

Finally it should be noted that the use of the container according to the invention is in principle not limited to cosmetic products. In principle such an applicator device can be used in all areas in which a metered amount of a substance in powder form is to be transferred by means of an applicator on to a surface and sufficiently accurately metered and in particular definedly reproducibly metered loading of the applicator element with the substance in powder form is to be guaranteed substantially independently of the filling level of the container.

The invention claimed is:

1. An applicator device comprising at least one housing, a storage container for holding a loose substance in powder form and a handle portion on which there is disposed an applicator which, in a closed condition of the applicator device, is arranged in the interior of the housing in the direction of the storage container, the storage container having a first wall and a second wall, wherein the first wall of the storage container is proximate to the applicator and has passageways so that the wall is permeable for the loose substance, and means for producing at least one impact on the second wall of the storage container so that a part of the loose substance in the storage container passes through the passageways of the first wall of the storage container and is loaded on to the applicator and wherein the storage container is axially movable within the housing and the means for producing the at least one impact is formed by at least a part of the housing as the storage container is moved in the housing over a predetermined distance so that the impact is produced by collision of the storage container with the housing.

2. An applicator device as set forth in claim 1 wherein the applicator is a brush.

3. An applicator device as set forth in claim 1 wherein the applicator is a flat surface element comprising a material selected from the group consisting of a fabric, foam, artificial leather and sponge rubber.

4. An applicator device as set forth in claim 1 wherein the applicator comprises a flocked carrier material.

5. An applicator device as set forth in claim 1 wherein geometrical dimensions of the individual holes are matched to the particle size of the loose substance.

6. An applicator device as set forth in claim 1 and further including the loose substance;

wherein the loose substance is a cosmetic powder.

* * * * *